United States Patent [19]

Skinner

[11] Patent Number: 4,677,943

[45] Date of Patent: Jul. 7, 1987

[54] AUTOMOTIVE NON-PRESSURE COOLING SYSTEM

[76] Inventor: Alan A. Skinner, 19 Hillcrest Ave., Brockton, Mass. 02401

[21] Appl. No.: 835,638

[22] Filed: Mar. 3, 1986

[51] Int. Cl.[4] ..... F01P 11/02

[52] U.S. Cl. ..... 123/41.27

[58] Field of Search ..... 123/41.27; 165/104.27, 165/104.32, 43

[56] References Cited

U.S. PATENT DOCUMENTS

| | | | |
|---|---|---|---|
| 1,852,770 | 4/1932 | Duesenberg | 123/41.27 |
| 2,672,853 | 3/1954 | Donnigan | 123/41.27 |
| 3,614,982 | 10/1971 | Krizman | 123/41.54 |
| 3,636,935 | 1/1972 | Martens | 128/41.1 |
| 3,820,593 | 6/1974 | Pabst | 165/104.32 |
| 4,346,757 | 8/1982 | Cheong et al. | 123/41.27 |
| 4,510,893 | 4/1985 | Schineiger et al. | 123/41.27 |

*Primary Examiner*—William A. Cuchlinski, Jr.
*Attorney, Agent, or Firm*—Wolf, Greenfield & Sacks

[57] ABSTRACT

In an automotive engine cooling system having a radiator and coolant pump, a non-pressure technique including a radiator cap seals to the radiator but permitting free flow of the coolant under expansion from the radiator to the expansion tank. The radiator cap seals to the radiator but provides a substantially non-pressure and unimpeded coolant path from the radiator to the coupling tube that leads to the expansion tank. A return line couples from the expansion tank to the suction side of the coolant pump. A second embodiment additionally employs a fill tank that is associated with and couples to the expansion tank.

12 Claims, 4 Drawing Figures

AUTOMOTIVE NON-PRESSURE COOLING SYSTEM

BACKGROUND OF THE INVENTION

The present invention relates in general to an automotive cooling system and pertains, more particularly, to a cooling system for a motor vehicle that is essentially a non-pressure system that is thus adapted to operate at ambient pressure.

Automotive cooling systems are adapted to operate under a certain degree of pressure so as to raise the boiling point of the coolant beyond its boiling point at standard temperature and pressure. Thus, to improve the cooling efficiency, automobiles use a pressure cap on the radiator such as illustrated herein in the prior art drawing of FIG. 1. FIG. 1 schematically illustrates the radiator 10 with the standard gooseneck 12 and supporting the pressure cap 14. It is noted that the gooseneck 12 is provided with an outlet port at 16 to which is connected the line 18 that essentially connects from the radiator to the expansion tank 20. The expansion tank 20 is provided also with a cap 22 and a vent line 24.

It is noted in the prior art diagram of FIG. 1 that the cap 14 is a pressure cap that seals at the top of the gooseneck at 15 and furthermore provides a pressurizing seal at 17.

At sea level, where atmospheric pressure is about 15 p.s.i., water boils at 212° F. At higher altitudes, where atmospheric pressure is less, water boils at lower temperatures. Higher pressures increase the temperature required to boil water. The use of a pressure cap on the radiator increases the air pressure within the cooling system several pounds per square inch. Thus, the water may be circulated at higher temperatures without boiling.

The pressure cap 14 contains two valves, a blow-off valve and a vacuum valve. The blow-off valve consists of a valve held against a valve seat by a calibrated spring. In FIG. 1 note the spring 19. The spring holds the valve closed providing the seal at 17 so that pressure is produced in the cooling system. Pressure rises above that for which the system is designed, the blow-off valve is raised off its seat, relieving the excessive pressure. Pressure caps are designed to provide as much as 18 pounds of pressure per square inch in the cooling system; this increasing the boiling point of the water to almost 250° F. This prior pressurized system is completely filled with a coolant as illustrated in FIG. 1 and is sealed with a tight cap that has a spring loaded release and that also includes a vacuum valve. As the engine starts to warm up, pressure starts to build in the system. When it reaches the amount of pressure the cap is designed for, such as the aforementioned 18 pounds, coolant is released, which passes through the hose 18 into the recovery or expansion tank 20. The hose enters the tank at the bottom as illustrated in FIG. 1 so that the end is always in the coolant. This insures exclusion of air into the system during the time of cool-down, when the engine is turned off, and when the system reverts from pressure to vacuum. It is at this time that the vacuum valve in the radiator cap comes into use, opening and using the vacuum in the cooling system to draw the coolant from the recovery tank back into the radiator. Thus, the system is kept full of coolant at all times. One of the problems, however, is that when a leak occurs, the excessive pressure accelerates the leak and vacuum will introduce unwanted air into the system.

Because of these excess pressures in present day cooling systems, there are scores of places in the cooling system where components thereof are subject to internal pressures. For example, radiator fluid tubes can corrode or be weakened by mechanical flexing, leaving a poor supporting material to contain the coolant. The same is true for the heater core. With these pressurized systems, the heater core and main radiator hoses eventually weaken from the destructive effects of the substantially increased pressures. Because of these pressurized systems, there is a need for constant retightening of hose clamps, but this can create tears in other weakened points where coolant can escape. Then there are the engine freeze plugs, which, if sufficiently corroded, can be blown out by excess pressure. Water pump shaft seals, O-rings, and block mounting gaskets are also potential weak points in these highly pressurized systems. In some vehicles, water jacket channels run between major engine components, such as the intake manifold and the block; the gasketed joints can also thus be vulnerable to pressure induced leakage. Once a serious pressure leak has occurred, the motorist runs a great risk of catastrophic damage to the engine. The engine block and the crank case oil can absorb heat for a short period of time, but soon thereafter, the engine seizes and is essentially destroyed.

Accordingly, it is an object of the present invention to provide an approved automotive engine cooling system which is essentially a non-pressure system and one in which provision is made for an expansion tank used in association with the cooling system.

Another object of the present invention is to provide a non-pressure cooling system for an automobile in which the coolant expansion tank is connected in a feedback arrangement with the automotive cooling system so as to maintain the proper amount of coolant in the system at all times, but without the attendant problems associated with present high pressure systems.

Prior Art Patents

The following are a list of prior art patents relating to automotive cooling systems:

3,614,982 10-26-81 John M. Krizman
3,662,820 5-16-72 Bob N. Myer
4,346,757 8-31-82 Alex S. Cheong, et al
4,473,037 9-25-84 Michassouridis, et al All of the above patents employ a cooling system in which the system operates on a pressurized basis with all of the aforementioned problems associated therewith.

SUMMARY OF THE INVENTION

To accomplish the foregoing and other objects, features and advantages of the invention, there is provided a non-pressure automotive engine cooling system. The cooling system generally includes a radiator containing a liquid coolant that is adapted to keep the automotive engine at a proper temperature by circulating water through the automotive engine. Coupling hoses are used to intercouple the radiator to the engine. Pump means typically identified as a water pump is associated with the engine usually bolted thereto for circulating coolant through the engine and radiator. The pump means has a suction side. A radiator cap is sealed on the radiator and in this connection, the radiator typically is provided with a gooseneck with the radiator cap sealably engaged with the gooseneck. The gooseneck also has an outlet port below the area where the cap seals to the gooseneck. An expansion tank is disposed in the engine compartment and has associated therewith, vent means for venting the tank to atmosphere. A coupling tube is disposed between the radiator below the radiator cap and the expansion tank. In this connection, the aforementioned outlet port at the gooseneck receives this coupling tube. This arrangement enables free flow of the coolant under expansion from the radiator to the expansion tank. This outlet port is continuously open to provide free fluid flow under non-pressure conditions. In this regard, the radiator cap seals to the radiator at the gooseneck, but provides a substantially non-pressure and unimpeded fluid path from the radiator to the coupling tube and hence to the expansion tank. A return line couples from the expansion tank to the suction side of the pump means.

In one embodiment in accordance with the invention, the expansion tank may be made relatively small in height, on the order of three inches so that there is sufficient clearance with the hood of the vehicle. The water level in the expansion tank for the most part matches the water level in the radiator. In an alternate embodiment of the invention, there is also provided a separate fill tank disposed at least in part above the expansion tank and having associated therewith a coupling hose that intercouples the fill tank and expansion tank. The fill tank also has a removable fill cap which is preferably vented. The fill tank may be mounted in the engine compartment on the fire wall. The coupling hose is connected preferably from the bottom end of the fill tank to a top end of the expansion tank.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
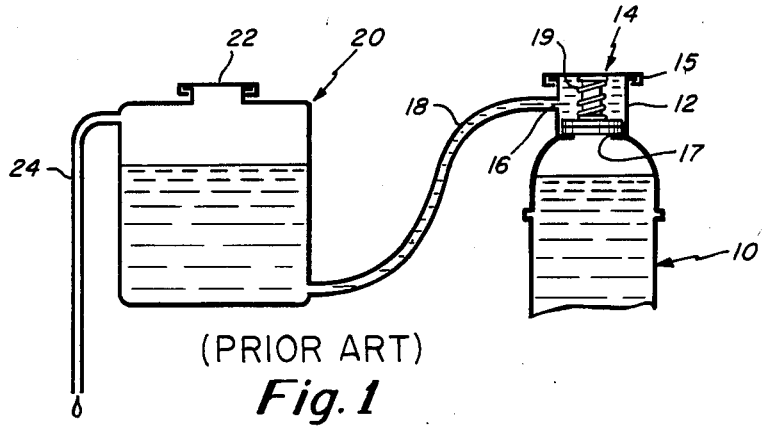
(PRIOR ART) Fig. 1
FIG. 1 is a schematic diagram of a prior art arrangement for the use of an expansion tank in association with a pressurized cooling system.

Reference has been made hereinbefore to the prior art drawing of FIG. 1 and in particular to the illustration of a high pressure cap 14 that it is noted, under normal operating conditions, provides a seal with the main part of the radiator as indicated at 17 in FIG. 1 essentially preventing any of the coolant from circulating to the hose 18 under normal operating conditions. Such as pressurized cooling system creates many problems referred to hereinbefore that cause major deterioration of substantial parts of the automobile engine and the automotive cooling system.

Figure 2:
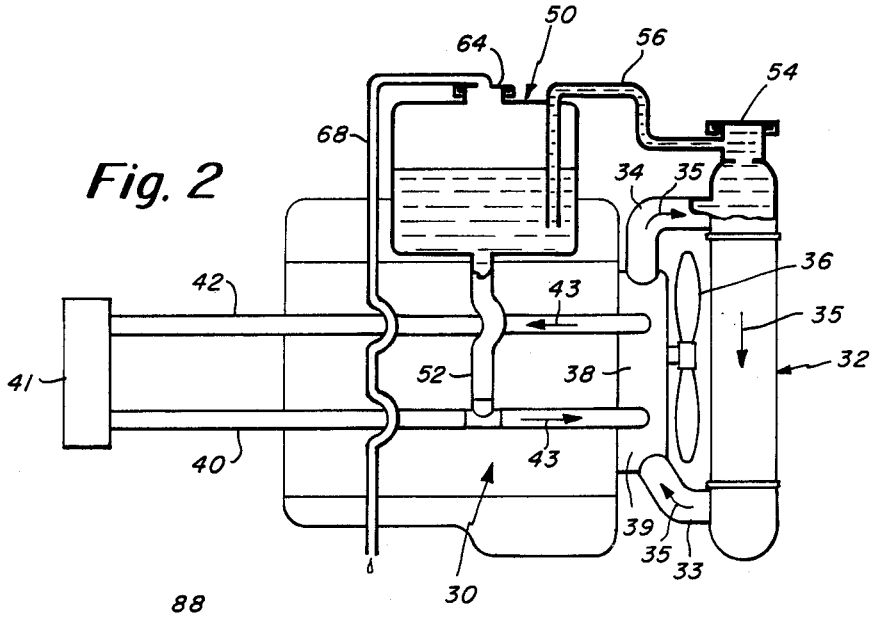
FIG. 2 is a schematic diagram showing one embodiment in accordance with the present invention in a non-pressure system.

Reference is now made to one embodiment of the present invention illustrated in FIG. 2. There is shown therein the automobile engine 30 which may be a conventional internal combustion engine having a water jacket through which the liquid coolant is circulated for the purpose of maintaining the engine at the proper operating temperature. For this purpose, there is provided a radiator 32 that has associated therewith, a lower hose 33 and an upper hose 34. In FIG. 2 the arrows 35 show the general direction of circulation of the coolant through the hoses 33 and 34 and the radiator 32. FIG. 2 also shows the fan 36 that is generally mounted and supported from the water pump illustrated at 38 in FIG. 2. FIG. 2 is a schematic diagram and thus the water pump 38 is shown for the purpose of simplicity in larger scale than would normally be the case. In this regard, the water pump may be considered as having a suction side 39 and in this regard, it is noted that the hole 33 connects thereto. This is for the purpose of drawing liquid out of the radiator, once the liquid coolant has been cooled, and for then expelling the coolant via the water pump 38 into the engine block. In this regard, it is noted that there is also provided, a pair of heater hoses 40 and 42 connecting to the heater 41. The arrows 43 illustrate the direction of coolant flow in the hoses 40 and 42. It is noted that the hose 40 connects also to the suction side 39 of the water pump 38. The hose 43 connects to the force side of the water pump or typically connects to a portion of the block that receives the pumped water. Of course, the water is also pumped, from the water pump 38 through the engine block and back out through the hose 34 into the radiator.

Figure 4:
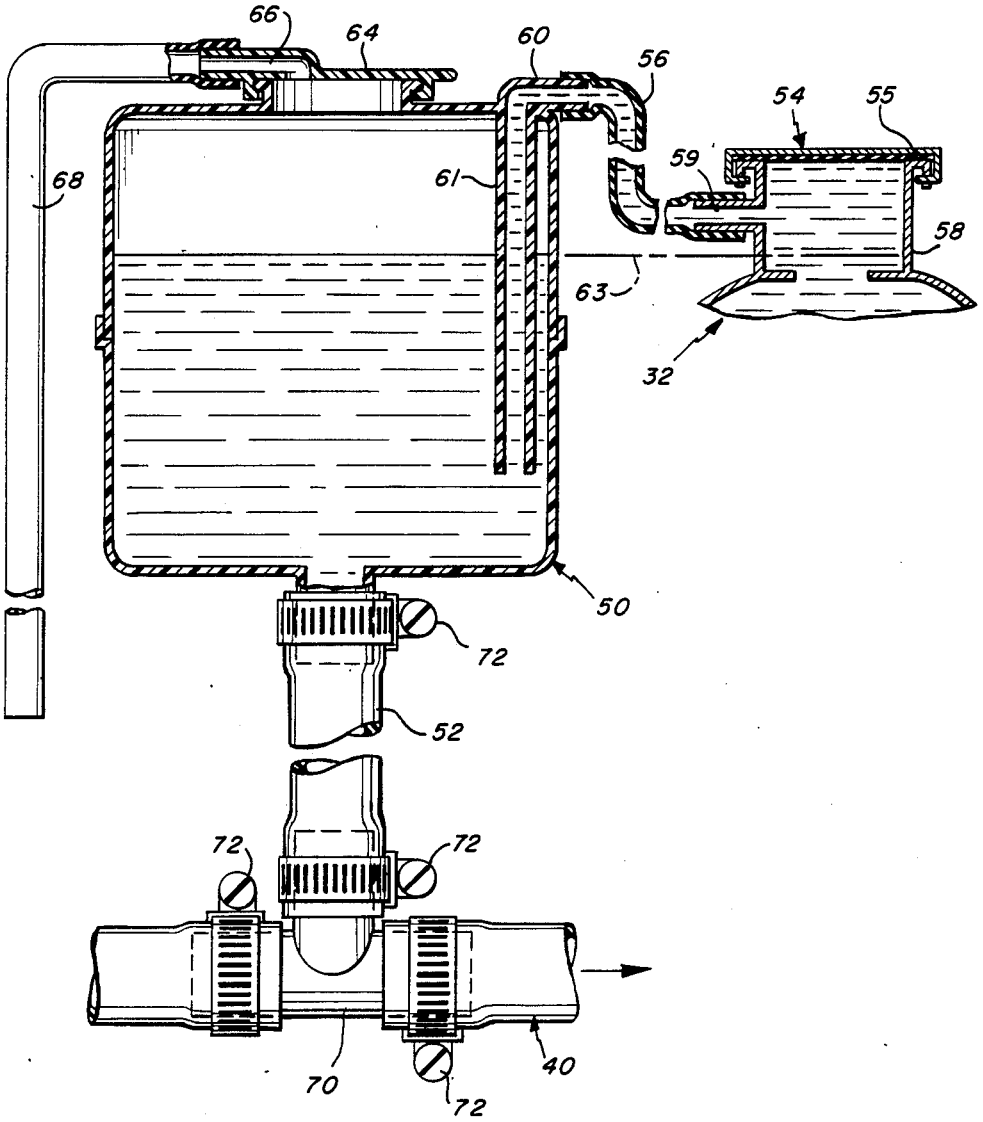
FIG. 4 is a more detailed diagram of the embodiment illustrated in FIG. 2.

Now, reference is also made to FIG. 4 which shows further details of, in particular, the expansion tank 50, the coupling via the return line 52, and the particular radiator cap 54 that is being employed in accordance with the invention. FIGS. 2 and 4 also show the coupling tube 56 that interconnects from the radiator gooseneck 58 to the inlet 60 associated with the expansion tank 50.

The radiator gooseneck 58 has an outlet at 59 to which the coupling tube 56 is connected. A small clamp may be used to secure the coupling tube, although the clamp is not shown in FIG. 4. It is noted in FIG. 4 that the path from the radiator through the outlet 59 to the coupling tube 56 is always open. This is due to the type of radiator cap that is employed in accordance with the present invention. Rather than the radiator cap 14 illustrated in FIG. 1, in accordance with the present invention, there is provided a non-pressure system in which the radiator cap 54 only seals peripherally at 55 to the very top of the gooseneck. However, the coolant is free to be expelled, as illustrated in FIG. 4 from the radiator, through the coupling tube 56 to the inlet 60 and from there into the inside of the expansion tank 50 via the vertical tube 61.

FIG. 4 illustrates the liquid being expelled into the expansion tank. However, under normal operating conditions, the liquid level line should be approximately the same in both the radiator and the expansion tank and thus it is desired to mount the expansion tank in a position in which at least a part thereof extends to the area of the gooseneck or higher. In this connection under normal operating conditions, it is noted that the liquid level line which may be the same in both the radiator and the expansion tank is approximately at the line 63.

The expansion tank 50 also has a vented cap 64, the details of which are illustrated in FIG. 4. Note the vent at 66. This couples to an overflow tube 68. Thus, no pressure is developed either in the radiator or in the expansion tank. In this way the coolant is permitted to simply expand as it is heated into the expansion tank and from there is recirculated into the cooling system by virtue of the return line 52 which couples to the heater hose line 40 by means of the T-connection 70, such as illustrated in FIG. 4. FIG. 4 also illustrates standard radiator clamps 72 that are used for interconnecting the different hoses. Thus, the expansion tank return line 52 is essentially coupled by way of line 52 and hose 43 to the suction side of the water pump. This thus provides for a continuous recirculation of coolant, but always maintaining some minimum predetermined amount of reserve fluid in the expansion tank. Because of the non-pressure aspect of the present system, there is substantially less likelihood of leaks developing in hoses and there is substantially less likelihood of general deterioration of the cooling and automotive system.

Figure 3:
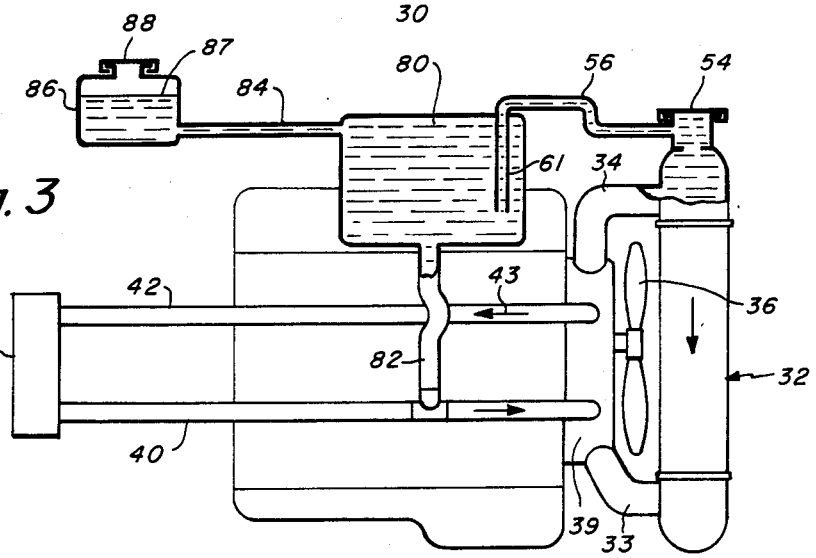
FIG. 3 is a second embodiment of the invention employing both a fill tank and an expansion tank.

FIG. 3 shows an alternate embodiment of the present invention. In FIG. 3 like reference characters are used to identify like parts of the system as previously illustrated in FIG. 2. Thus, in FIG. 3 there is provided the radiator 32, the heater 41, the water pump 39, and the radiator hoses 33 and 34. FIG. 3 also shows the radiator cap 54 of the type identified in FIG. 4 along with the coupling tube 56 that extends to the expansion tank. In FIG. 3 the expansion tank is of somewhat different construction. This expansion tank 80 likewise has a return line 82 to the heater hose 40. The coupling at the heater hose 40 may be substantially the same as illustrated in FIG. 4 by the T-connection 70. The expansion tank 80 receives the vertical tube 61, but instead of having a fill cap, there is provided a further coupling tube 84 that connects to a fill tank 86. The fill tank has a cap 88 that is preferably vented so that the system maintains a non-pressure status. In the embodiment of FIG. 3 it is preferred to maintain the expansion tanks substantially full, thus maintaining the radiator substantially full, with excess coolant being provided in the fill tank 86. The fill tank may be supported in a suitable manner from the fire wall of the vehicle. Although the expansion tank 80 is shown as being of the same size as the expansion tank 50 in the version of FIG. 2, with the use of a fill tank 86, it is possible to make the expansion tank smaller and generally of smaller height so that it can be accommodated properly in the space required under the hood of the vehicle and between the hood and the engine block. In the embodiment of FIG. 3, all filling of the cooling system can occur at the fill tank 86. It is noted that the fill tank 86 is disposed generally at a higher position than the expansion tank and the radiator. Note in FIG. 3 the coolant level line 87 in the fill tank 86.

The embodiment of FIG. 3 operates similarly to the embodiment of FIG. 2. The coolant from the radiator is coupled via the coupling tube 56 to the expansion tank where the coolant is returned via the return line 82 to the suction side of the pump causing a substantially continuous recirculation, particularly under coolant heating conditions.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A non-pressure automotive engine cooling system comprising; a radiator containing a liquid coolant, coupling hoses that intercouple the radiator to the engine, pump means associated with the engine for circulating coolant through the engine and radiator, said pump means having a suction side, a radiator cap sealed on the radiator, an expansion tank disposed in the engine compartment, vent means on the tank for venting the tank to atmosphere, a coupling tube disposed between the radiator below the radiator cap and the expansion tank to enable free flow of the coolant under expansion from the radiator to the expansion tank, said radiator cap sealing to the radiator but providing a substantially non-pressure and unimpeded fluid path from the radiator to the coupling tube, a return line coupled from the expansion tank to the suction side of the pump means, said radiator having a gooseneck with the radiator cap sealably engaged with the gooseneck, an outlet port from the top of the radiator to which the coupling tube is connected, said outlet port being continuously open and unblocked by said radiator cap to provide free fluid flow from the radiator to the expansion tank over the entire operating temperature range, said radiator cap sealing only at the top of the gooseneck, and means for supporting said expansion tank at a position at a height corresponding to the top of the radiator whereby under normal temperature range operating conditions the liquid level line is substantially the same in both the radiator and the expansion tank.

2. A non-pressure automotive engine cooling system as set forth in claim 1 wherein said coupling tube includes a vertical section entering the top of the expansion tank and extending downwardly into the expansion tank terminating at an open end open to the bottom of the expansion tank.

3. A non-pressure automotive engine cooling system as set forth in claim 2 wherein said expansion tank has a cap that is vented to form said vent means.

4. A non-pressure automotive engine cooling system as set forth in claim 1 including a heater core and hose lines coupling between the pump means and heater core for supplying heated coolant to the heater core.

5. A non-pressure automotive engine cooling system as set forth in claim 4 wherein said return line couples to one of said heater core hose lines that in turn couples to the suction side of the pump means.

6. A non-pressure automotive engine cooling system as set forth in claim 5 including means forming a T-connection between the return line and suction side heater core hose line.

7. A non-pressure automotive engine cooling system as set forth in claim 1 including a separate fill tank disposed at least in part above the expansion tank and a coupling hose intercoupling the fill tank and expansion tank.

8. A non-pressure automotive engine cooling system as set forth in claim 7 wherein said fill tank has a removable fill cap.

9. A non-pressure automotive engine cooling system as set forth in claim 8 wherein said fill tank is mounted in the engine compartment on the firewall.

10. A non-pressure automotive engine cooling system as set forth in claim 9 wherein said coupling hose is connected from a bottom end of the fill tank to a top end of the expansion tank.

11. A non-pressure automotive engine cooling system comprising; a radiator containing a liquid coolant, coupling hoses that intercouple the radiator to the engine, pump means associated with the engine for circulating coolant through the engine and radiator, said pump means having a suction side, a radiator cap sealed on the radiator, an expansion tank disposed in the engine compartment, vent means on the tank for venting the tank to atmosphere, a coupling tube disposed between the radiator below the radiator cap and the expansion tank to enable free flow of the coolant under expansion from the radiator to the expansion tank, said radiator cap sealing to the radiator but providing a substantially non-pressure and unimpeded fluid path from the radiator to the coupling tube, and a return line coupled from the expansion tank to the suction side of the pump means, a heater core and hose lines coupling between the pump means and heater core for supporting heated coolant to the heater core, said return line coupling one of said heater core hose lines that in turn couples to the suction side of the pump means.

12. A non-pressure automotive engine cooling system as set forth in claim 11 including means forming a T-connection between the return line and suction side heater core hose line.

* * * * *